United States Patent [19]

Parker

[11] Patent Number: 4,926,997

[45] Date of Patent: May 22, 1990

[54] APPARATUS AND METHOD FOR RESTARTING A COIN OPERATED DEVICE AFTER EXPIRATION OF TIME

[76] Inventor: Donald O. Parker, 1003 Spring St., Grand Rapids, Mich. 49503

[21] Appl. No.: 247,705

[22] Filed: Sep. 22, 1988

[51] Int. Cl.[5] ..... G07F 17/20; G07F 5/16

[52] U.S. Cl. ..... 194/231; 194/241; 194/353; 194/904

[58] Field of Search ..... 194/216, 217, 229, 230, 194/231, 239, 240, 241, 350, 353, 904; 15/53 R, 53 A, 97 B; 134/123; 222/2

[56] References Cited

U.S. PATENT DOCUMENTS

| | | | |
|---|---|---|---|
| Re. 26,957 | 9/1970 | McConnell | 194/231 X |
| 2,564,762 | 8/1951 | Howard et al. | 194/241 X |
| 3,438,580 | 4/1969 | Siebring | 134/123 X |
| 3,933,231 | 1/1976 | Vinet | 194/241 |
| 4,383,210 | 5/1983 | Wilkinson | 194/216 X |
| 4,541,519 | 9/1985 | Belviso et al. | 194/241 |
| 4,566,033 | 1/1986 | Reidenouer | 194/241 X |

*Primary Examiner*—Joseph J. Rolla
*Assistant Examiner*—Edward S. Ammeen
*Attorney, Agent, or Firm*—Leydig, Voit & Mayer

[57] ABSTRACT

A coin operated device and method of using such a device which requires a threshold number of coins to activate its operation. Once operation is stopped, however, there is provided a time window, during which the deposit of fewer than the threshold number of coins may restart the device.

18 Claims, 4 Drawing Sheets

APPARATUS AND METHOD FOR RESTARTING A COIN OPERATED DEVICE AFTER EXPIRATION OF TIME

FIELD OF THE INVENTION

This invention relates to coin operated devices and more particularly to reactivating coin operated devices following expiration of the originally allotted time and, specifically, in devices in use in the self-service car wash industry.

BACKGROUND OF THE INVENTION

In self-service car washes in use today, a customer drives his vehicle into a bay where there is located a coin operated device designed to provide a number of liquid solutions through a pressurized hose and applicator. The solutions often include such things as a soap solution, a water solution, etc., which may be selected via a selector switch and may be changed any time during the use of the device. The device usually works on quarters for an mount of time proportional to the number of quarters inserted. Given the choice, a typical customer would run the device for a short period of time to cover his vehicle with soap. Thereafter, leisurely clean his vehicle by hand without time pressure and, once finished, would run the device again for a short time to water off the remaining soap. This procedure, however, ties up the bay for an extended period of time and provides the owners with the least revenue.

It is for the above reasons that many self-service car wash owners have installed devices that require the deposit of four or more quarters before the device will operate. Once the four quarters are deposited, the device will run for the anticipated time that the average customer needs to complete his wash. If the customer requires more time, he may deposit additional quarters any time while the device is operating. Since most customers want to get the wash completed with the least expense, customers often deposit only the minimum number of quarters to initiate operation of the device—typically four.

While the customer may insert more coins for additional time, most choose to try to beat the timer and complete the wash in the time allotted given the minimum number of coins necessary to start operation. In so doing, many customers find they need a small amount of additional time after the timer has expired. However, inserting another four quarters to finish the wash, which requires say, one more quarter's worth of time, frustrates the customer. To this end, manufactures of self-service car wash equipment have installed digital time readouts which indicate to the customer how much time is left so that they may better gauge if additional money is necessary before the device shuts off. Attempts along these lines have also included horns that sound or lights that flash in the last remaining minute. These warning systems have, however, been expensive, subject to vandalism and difficult to maintain. Moreover, these systems have been largely ineffective in that customers hurry to finish when they hear the horn or see the flash of lights and still do not finish in time and must deposit four more quarters to restart operation. A better system is necessary.

SUMMARY OF THE INVENTION

It is an object of the present invention to provide a coin operated machine with a way of providing extra operating time after the original operating time has expired.

It is a more detailed object of the present invention to provide a self-service car wash device with a way of restarting without the necessity of repeating the original start-up procedure.

It is a related object of the present invention to differentiate between the necessity for the restart procedure and the start-up procedure.

These objects and advantages are accomplished in the present invention which provides for extended operating time after the coin operated device shuts off. In one embodiment, a Read Only Memory (ROM) of a microprocessor based coin operated device requires a plurality of coins to be inserted to initiate operation of the device. Additionally, the microprocessor is programmed to accept a single coin restart procedure within a predetermined time window after the device stops operating.

In another, discreet digital component embodiment, a timer circuit detects a twenty second time window following the device shut off. Within this time window a single coin deposit will allow the restarting of the device.

In a third, analog embodiment, the time window is determined by a RC timing circuit.

BRIEF DESCRIPTION OF THE DRAWINGS

Other objects and advantages will become apparent from the attached detailed description and upon reference to the drawings, in which.

DETAILED DESCRIPTION OF THE PREFERRED EMBODIMENT

While the invention will be described in connection with a preferred embodiment, it will be understood that there is no intention to limit the invention to that embodiment. On the contrary, it is intended to cover all alternatives, modifications and equivalents as may be included within the spirit and scope of the invention as defined by the appended claims.

Figure 1:
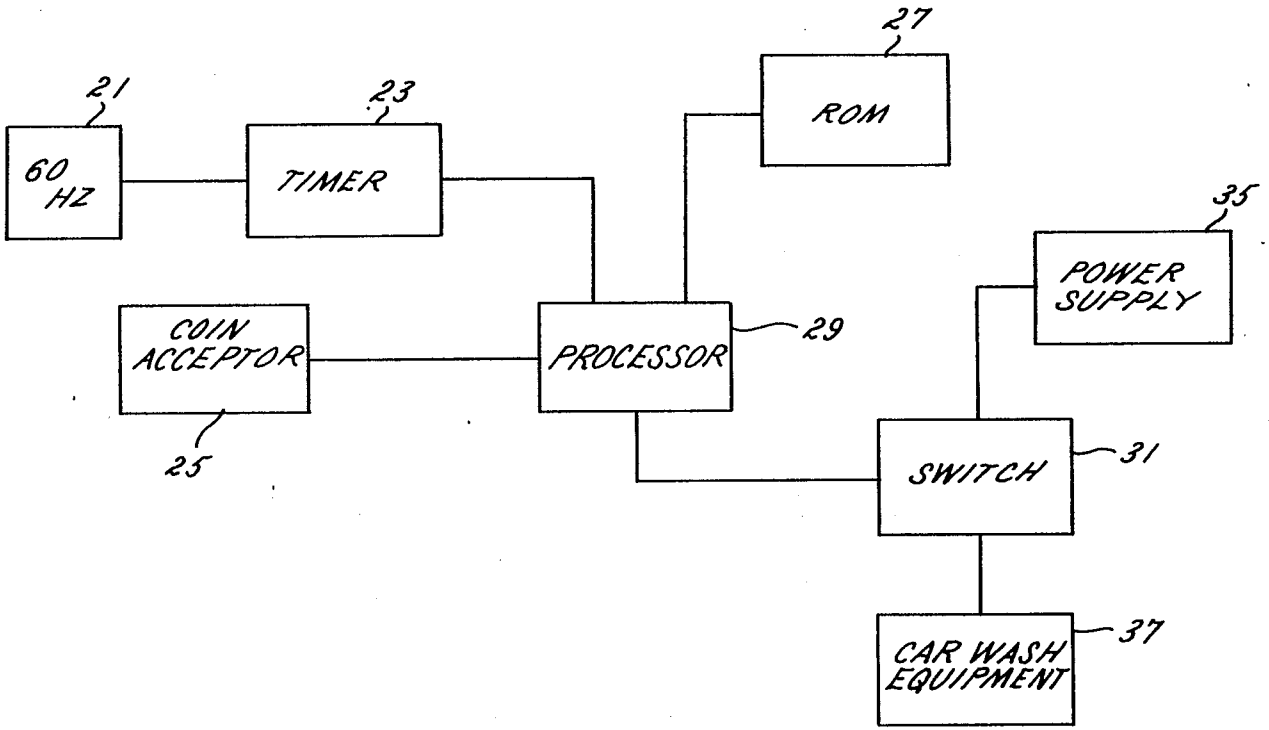
FIG. 1 is a block diagram of a microprocessor based self-service car wash apparatus according to the present invention.

Turning now to the drawings, a microprocessor based self-service car wash apparatus is depicted in FIG. 1. Processor 29 receives inputs from a 60 Hz power supply 21 through a timer 23. In order to begin operation, processor 29 also receives input through a coin acceptor apparatus 25 which may be of a number of kinds commercially available. Typically, and for the purposes of the illustrated embodiment, processor 29 must detect four or more coins at coin acceptor 25 in order to turn on the switch 31 and thus provide power from the power supply 35 to the car wash equipment 37. Read Only Memory (ROM) 27 is provided to control processor 29 for proper control of switch 31. ROM 27 may also be provided as part of the same unit as processor 29 as those skilled in the art may appreciate. Additionally, processor 29 is provided with all the conventional circuitry of a processor including RAM, registers, bus lines, etc.

Figure 2:
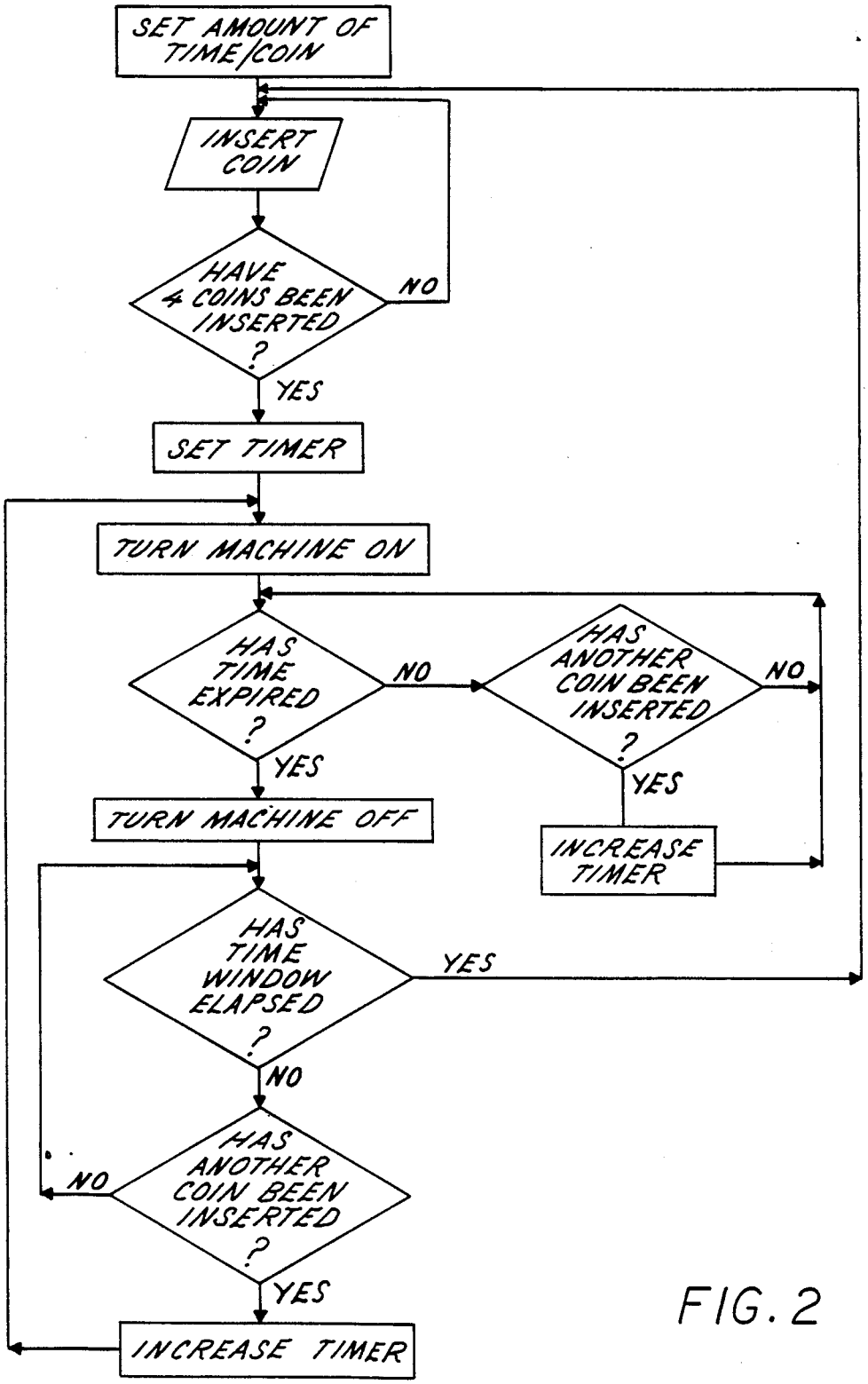
FIG. 2 is a flow chart of a program suitable for the microprocessor of the system shown in FIG. 1.

In order to illustrate the control of switch 31 by processor 29, FIG. 2 shows a flow diagram of an appropriate program which may be held in ROM 27. Preliminary, the amount of time that the coin operated device will run for each deposited coin must be set (Step 41). This may be accomplished through external control means (illustrated in an alternate embodiment explained below) and may be set and reset by each self-service car wash owner. Additionally, external means may also be provided to set the minimum number of coins necessary to begin operation. In the illustrated embodiment, four coins are necessary, and therefore, Step 45 tests for the four coin minimum condition. If four coins have not been deposited by the customer, the processor 29 simply waits until additional coins have been sensed (Step 43) through coin acceptor circuitry 25. Once the minimum number of coins, i.e., four, have been inserted into the coin operated device, a timer, usually of the count down type, is set (Step 47) and the machine is turned on (Step 49), ready for customer use.

The timer is usually set (Step 47) for the anticipated amount of time for many customers to complete their wash and, in the preferred embodiment, is set for four minutes. During normal operation, the processor 29 will monitor the time remaining on the count down timer (Step 51) and will turn the machine off when the time has expired (Step 57). As discussed above, in order to allow a customer more than the minimum allotted time, the machine is designed to accept additional coins and provide additional operating time therefor, at any time while the machine is operating. For this reason, if the time has not expired, the processor 29 monitors the coin accept 25 (Step 53). If additional coins are deposited during the equipment's operation, the amount of time remaining on the count down timer is increased at Step 55. Eventually, the customer will stop inserting coins and the timer will expire. At that time, the processor 29 will, through switch 31, turn off the car wash equipment 37 (Step 57).

In keeping with the invention, there is provided a means and method for restarting the coin operated self-service car wash equipment without depositing the same minimum number of coins necessary to start operation. In greater detail, and with reference to FIGS. 1 and 2, the processor 29 is programmed through the ROM 27 to start a time window running. In the preferred embodiment, this time window is set for approximately 20 seconds, during which a single coin deposit will restart the car wash equipment 37. With reference to FIG. 2, once the equipment is turned off (Step 57), after the user's time has expired (Step 51), processor 29 will test whether a 20 second time window has elapsed (Step 59). As illustrated at Step 61, if the customer deposits a coin within the established time window, the timer will be increased (Step 63) and the equipment will be reactivated (Step 49). Once the device is running, the customer has the same options as if he had started the device with four coins, i.e., continue to insert coins (Steps 51, 53 and 55) or restart the device after time has expired, but during the set time window (Steps 59, 61, 63 and 49).

Figure 3:
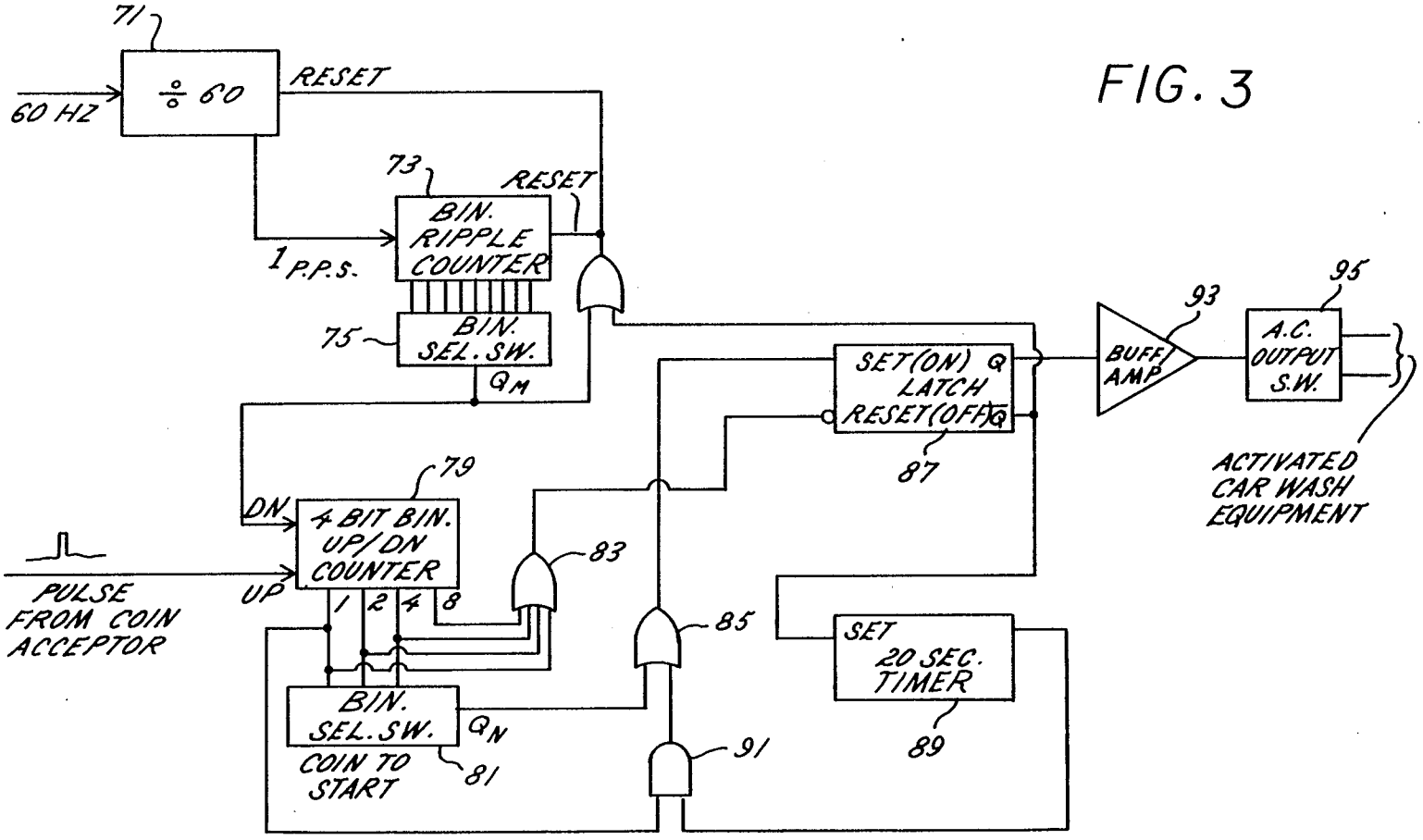
FIG. 3 is a digital flow diagram, partially in block form, of a digital embodiment of the present invention.

Turning now to FIG. 3, there is illustrated an alternate embodiment of the present invention which achieves similar results to the above embodiment. In order to establish the amount of time that the car wash equipment will run for each deposited coin, a standard 60 Hz source is shown with a "divide by 60" block 71 to produce one pulse per second feeding a binary ripple counter 73. By the selection of binary selector switches 75, which may be externally set by the equipment owner, the output, $Q_M$ will produce one pulse for each of a specified block of time. This block of time represents the amount of time the car wash equipment will run for each deposited coin, as will be apparent below.

In order to establish the number of coins necessary to begin operation of the equipment, binary selector switches 81 are used and may be externally set or changed when desired. As can be appreciated by FIG. 3, when $Q_N$, the output of binary selector switches 81, is high, latch 87 is set activating the car wash equipment through a buffer/amplifier 93 and the A.C. output switch 95. In order to insure that the car wash equipment is not activated until the minimum number of coins have been deposited, binary selector switches 81 are connected to the 1, 2 and 4 outputs of up/down counter 79, allowing for anywhere from 1 to 7 quarters to initiate operation. In operation, up/down counter counts up one for each coin accepted through a coin acceptor and counts down one for the passing of a block of time due for each deposited coin as explained above. Therefore, only when the combination of the up/down counter's 79 output lines corresponds to the selected binary switch combination will $Q_N$ be high, thus activating the car wash equipment.

From the above, and with further reference to FIG. 3, up/down counter 79 will have at least one of lines 1, 2, 4 and 8 high unless and until the time allotted for the inserted number of coins has expired. Therefore, only when time has expired will the output line from OR gate 83 be zero. Thus, through the inverted reset input of latch 87, the car wash equipment will be turned off, through A.C. output switch 95, in a similar manner to the above described processor based embodiment.

In keeping with an important aspect of the invention, the device is provided with a way of restarting the car wash equipment without the need to deposit the requisite four coins for initial operation. In greater detail, once output $\overline{Q}$ from the latch 87 goes high, signifying that time has expired and the car wash equipment is turned off, a 20 second timer 89 is set. During this 20 second time window in which the output line of the timer 89 is high, a single deposited coin will cause the output of AND gate 91 to go high, which in turn will cause the output of OR gate 85 to be high, thereby setting latch 87 and restarting the car wash equipment.

Figure 4:
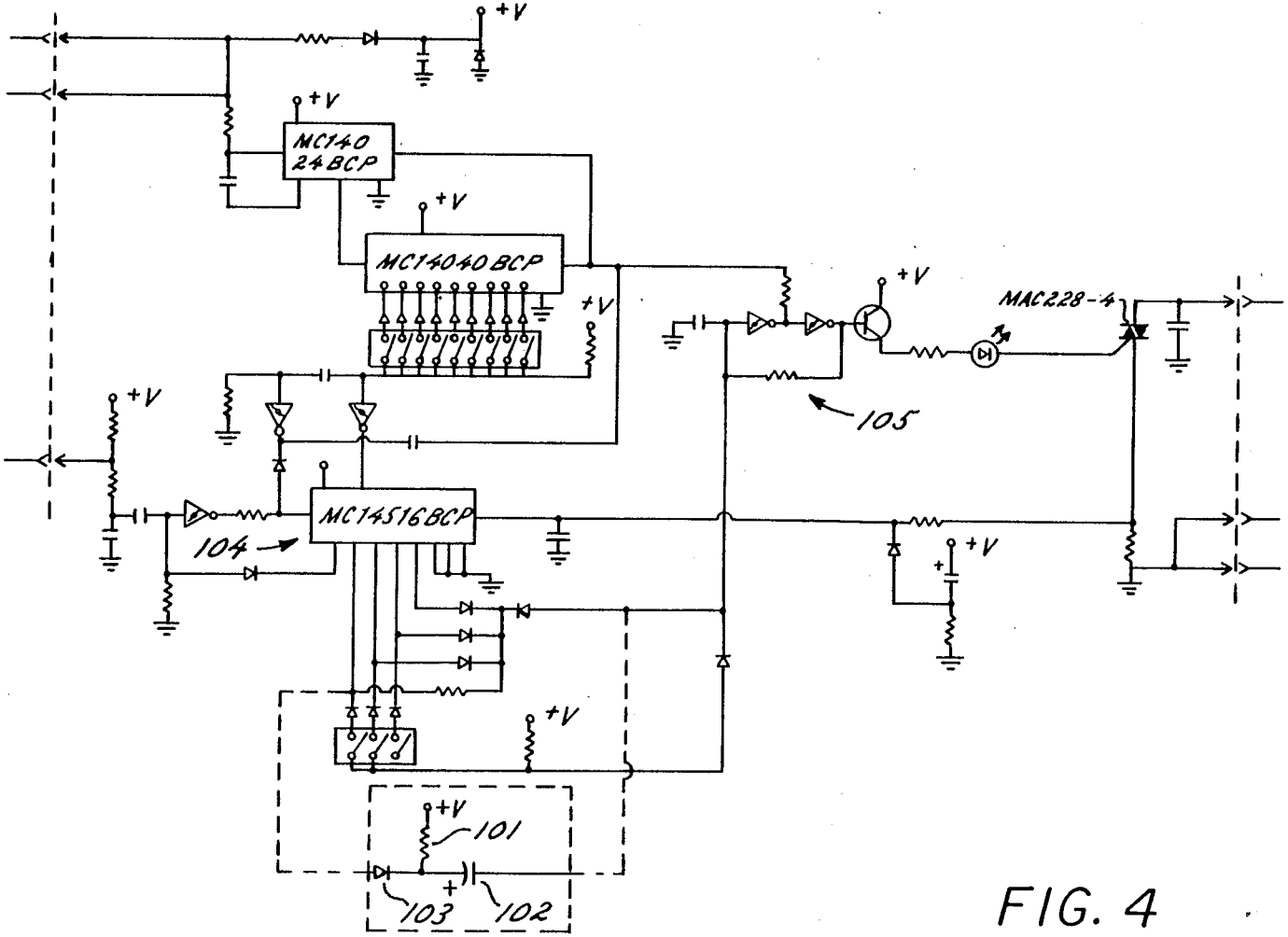
FIG. 4 is a digital/analog hybrid circuit diagram showing a prior art self-service car wash timer diagram with analog circuitry added according to the present invention.

In an alternate embodiment of the invention, FIG. 4 represents a digital/analog hybrid circuit embodying the invention. As much of this circuit is similar in results as the previously described embodiments and is commercially available as GINSAN model numbers GS 7 and GS 8 and Parker Engineering and Manufacturing model number PEM 7 (including the proper connections to the coin acceptor and car wash equipment), hereby incorporated by reference, the detail of FIG. 4 will not be explained here. In keeping with an important aspect of the invention, however, the conventional timing circuit is provided with a means and method of accepting a single coin to restart the car wash equipment within a set time window after the original time expires. To this end, an RC timing circuit in the form of resistor 101 and capacitor 102 are connected between the first output of up/down counter 104 and latch 105.

In operation, once latch 105 is turned off after having been on, i.e., the car wash equipment is turned off due to the expiration of time, a pulse from the deposit of a single coin will, through a diode 103, set the latch, thus turning the equipment back on. This single coin restart procedure will only occur if a coin is deposited while the capacitor is not fully discharged, i.e., during the time constant of the RC circuit, approximately 20 seconds in the illustrated embodiment. After such discharging time, the requisite four coins will be necessary to start operation.

Although not stated above, the car wash equipment may run on tokens or coins other than quarters, and for the purposes of this invention are equivalent. Additionally, the minimum number of coins to initiate operation may be variably set, as well as the number needed to restart operation. The time window for accepting coins for additional time may also be variably set as well. Moreover, this invention is not intended to be limited to use in the self-service car wash industry but may be applied in any coin operated device.

I claim:

1. In a coin operated device, an apparatus comprising, in combination, means for accepting deposited coins;

means for activating the device in response to at least a first predetermined plurality of deposited coins for a full preset first time period responsive to said deposited coins and deactivating said device upon the end of said first time period; and means for restarting said device for a second time period less than said first time period within a preset time window following expiration of said first time period in response to a deposit of less than said first predetermined plurality of coins.

2. An apparatus as claimed in claim 1 wherein said first predetermined plurality of coins is four.

3. An apparatus as claimed in claim 1 wherein said means for restarting said device comprises a processor.

4. An apparatus as claimed in claim 1 wherein said means for restarting said device comprises a timing circuit.

5. An apparatus as claimed in claim 1 wherein said means for restarting said device comprises an RC network.

6. An apparatus as claimed in claim 1 wherein said preset time window is approximately 20 seconds.

7. An apparatus as claimed in claim 1 wherein one coin is necessary to restart said device.

8. In a coin operated self-service car wash device having a switch means for alternatively supplying and cutting off power to said car wash equipment, and having a coin accepting device for accepting deposited coins, an apparatus comprising, in combination:

first means for detecting at least a predetermined plurality of coins deposited in said coin accepting device;

second means responsive to said first means for controlling said switch means to supply power to said car wash equipment for a time period responsive to said deposited coins, and, upon expiration of said time period, to cut off power to said car wash equipment; and third means for controlling said switch means to resupply power to said car wash equipment for less than said time period responsive to less than said predetermine plurality of coins deposited in said coin accepting device within a preset time window following said expiration of said time period.

9. An apparatus as claimed in claim 8 wherein said predetermined plurality of coins is four.

10. An apparatus as claimed in claim 8 wherein said third means comprises a processor.

11. An apparatus as claimed in claim 8 wherein said third means comprises a timing circuit.

12. An apparatus as claimed in claim 8 wherein said third means comprises an RC network.

13. An apparatus as claimed in claim 8 wherein said preset time window is approximately 20 seconds.

14. An apparatus as claimed in claim 8 wherein only one deposited coin is necessary to supply power to said car wash equipment within said preset time window following said expiration of said time period.

15. A method of using a coin operated device having a coin acceptor for accepting coins and a switch which may be activated for allowing power to flow to said device and deactivated for stopping the flow of power to said device, said method comprising the steps of:

activating said switch for allowing power to flow to said device in response to depositing a predetermined plurality of coins in said coin acceptor;

deactivating said switch for stopping the flow of power to said device following a time period determined by said deposited coins; and reactivating said switch for less than said time period in response to depositing less than said predetermined plurality of coins during a preset time window following said deactivating of said switch.

16. A method as claimed in claim 15 wherein said predetermined plurality is four.

17. A method as claimed in claim 15 wherein one deposited coin is necessary for said reactivating.

18. A method as claimed in claim 15 wherein said time window is approximately 20 seconds.

* * * * *